United States Patent [19]

Chang

[11] Patent Number: 4,842,134

[45] Date of Patent: Jun. 27, 1989

[54] CASE FOR CROQUET EQUIPMENT

[76] Inventor: Mao J. Chang, No. 32, 267 South Lane, Sec. 2, Tien Hsin Road, Feng Yuean City, Taichung Hsien, Taiwan

[21] Appl. No.: 240,933

[22] Filed: Sep. 6, 1988

[51] Int. Cl.[4] ..... B65D 85/20

[52] U.S. Cl. ..... 206/315.1; 206/579; 206/315.9; 206/486; 206/443; 273/56

[58] Field of Search ..... 206/14, 303, 315.1, 206/315.9, 314, 317, 372, 373, 375, 443, 483, 477, 486, 490, 562, 563, 564, 570, 571, 575, 579, 580, 587; 190/109, 127, 900; 273/56; 220/20

[56] References Cited

U.S. PATENT DOCUMENTS

| | | | |
|---|---|---|---|
| 54,848 | 5/1866 | Bradley | 273/56 |
| 2,538,924 | 1/1951 | Stearn | 220/20 |
| 3,145,619 | 8/1964 | Ozanne | 206/317 |
| 3,155,231 | 11/1964 | Vinas | 220/20 |
| 4,262,798 | 4/1981 | Raab | 206/315.1 |
| 4,340,140 | 7/1982 | Wilcox et al. | 206/373 |
| 4,353,464 | 10/1982 | Bentler | 206/564 |
| 4,619,364 | 10/1986 | Czopor, Jr. | 206/477 |

FOREIGN PATENT DOCUMENTS

| | | | |
|---|---|---|---|
| 858393 | 11/1940 | France | 206/373 |
| 1565476 | 5/1969 | France | 206/315.1 |
| 1517672 | 7/1978 | United Kingdom | 206/579 |

*Primary Examiner*—David T. Fidei

*Attorney, Agent, or Firm*—Fitch, Even, Tabin & Flannery

[57] ABSTRACT

A case for croquet equipment which is substantially rectangular comprising a lower case section and an upper case section. Being moulded integrally, the upper and lower case sections are connected together at one side, a handle being arranged on the opposite side of the lower case section. At each side of the handle, there is a lock provided respectively. Within the case sections, a plurality of different shaped recesses are moulded to receive the different equipment pieces.

1 Claim, 4 Drawing Sheets

CASE FOR CROQUET EQUIPMENT

BACKGROUND OF THE INVENTION

The present invention relates to a case for croquet equipment, comprising an upper case section and a lower end section, within the case sections there are a plurality of recesses disposed so as to contain the croquet equipment.

As well known, croquet is an ancient and popular sport. However, it is difficult to store and carry the whole set of the equipment. Usually, the equipment is put in a bag resulting in the equipment being subject to damage.

SUMMARY OF THE INVENTION

The object of the present invention, in order to obviate the drawbacks aforementioned, is to provide a case for storing croquet equipment, with many different recesses moulded integrally therein, to protect the croquet equipment from being damaged.

Another object in accordance with the present invention is to provide a portable case for croquet equipment.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
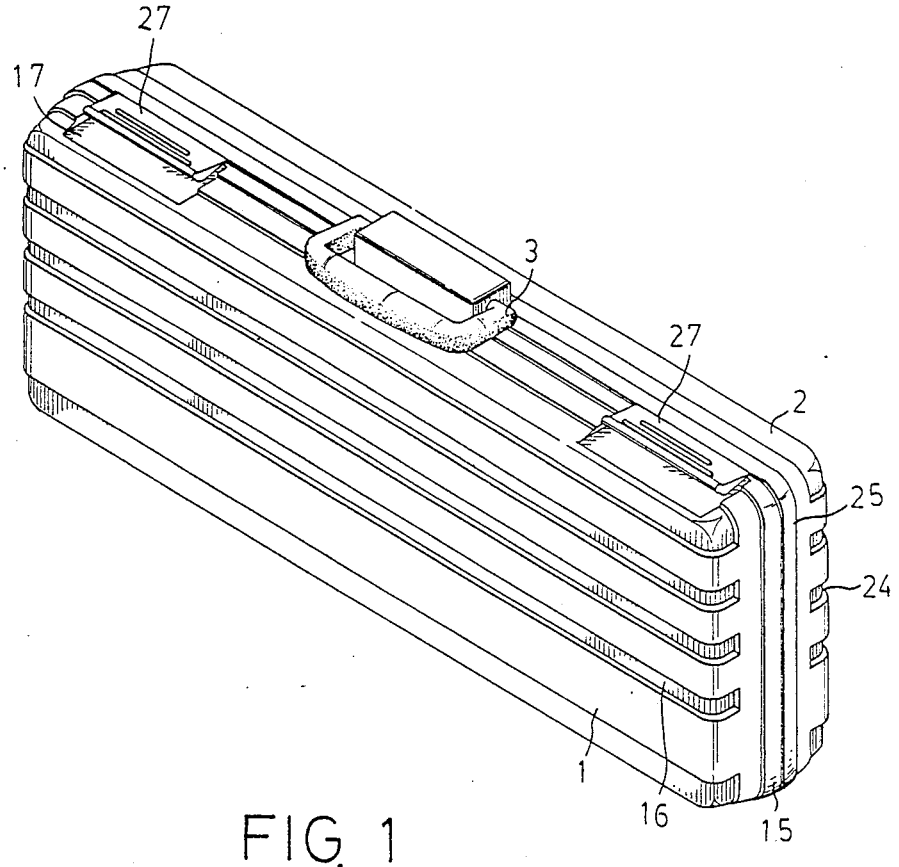
FIG. 1 is a perspective view according to the present invention.
Figure 2:
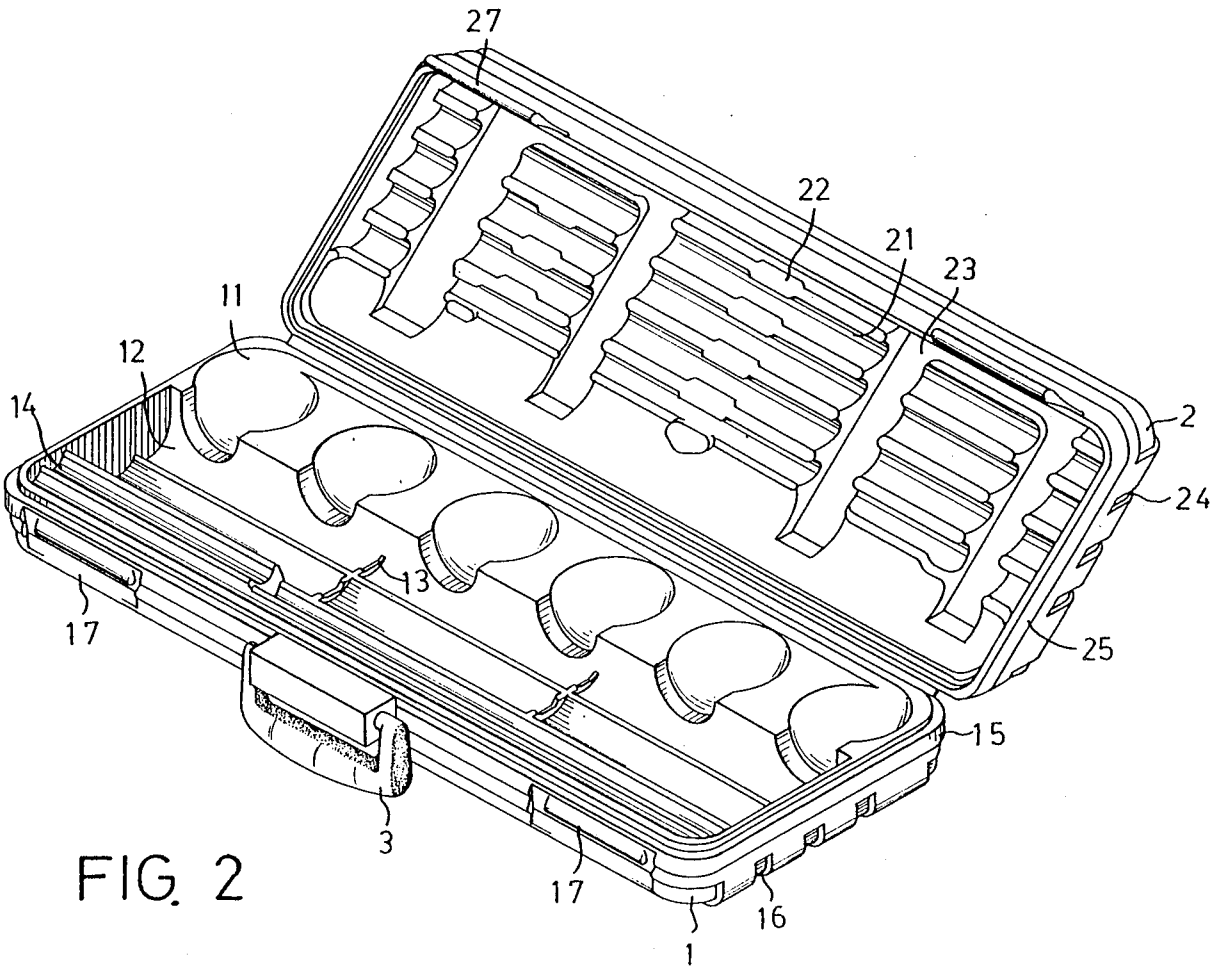
FIG. 2 is a perspective view of the opened case in accordance with the present invention.

As shown in FIGS. 1 and 2, the present invention is a substantially rectangular case for croquet equipment, comprising a lower case section 1 and an upper case section 2, a plurality of regular grooves being symmetrically disposed on the outer surface of each case section. The case sections are moulded together integrally to form a hinge at one side thereof enabling the case to open and close. As a result of the flanges 15 and 25, the case sections mate more properly. A handle 3 is provide on one side of the lower case section 1 opposite the hinged side, beside which two locks are arranged respectively as securing devices (shown in FIG. 1 and 2). Because of the handle 3, the case is made portable, and because of the locks, the upper case section is able to engage the lower case section and secure the case sections in the closed position.

Figure 3:
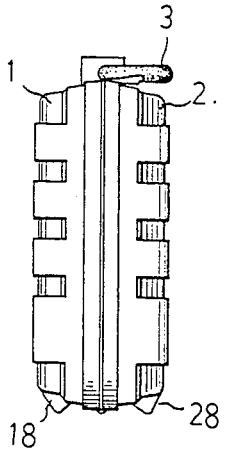
FIG. 3 is an end view thereof.
Figure 4:
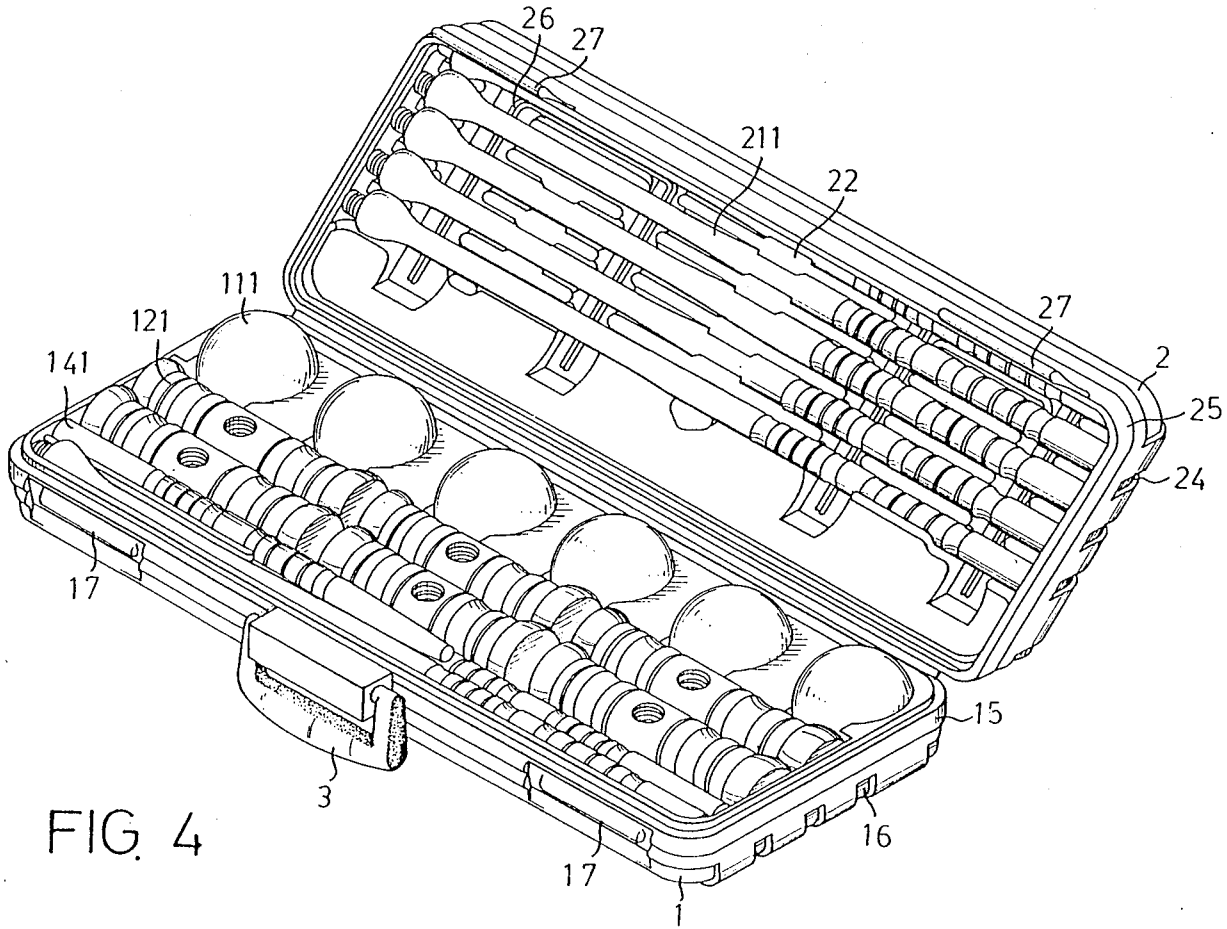
FIG. 4 is a perspective view of the embodiment of FIG. 2 in accordance with the present invention.

Referring to FIGS. 2 and 4, within the case sections 1 and 2, a plurality of irregularly shaped recesses are disposed accordingly to receive the different equipment. with in the lower case section 1, a plurality of ball sockets 11 are provide in alignment. In the vicinity of the ball sockets, two recesses 12 are divided by protruding elements 13 into a plurality of short recesses to receive the croquet mallets 121. A plurality of semicircular recesses 14 are disposed on different levels beside the recesses 12 to receive the stakes 141. Furthermore, in the upper case section 2, a plurality of concave elements 21 which are parallel each other and as long as the length of the cases are provided to receive the handles 211. Two U-shaped recesses 23, which are the same shape as the wickets 26, are positioned in the upper case section 2 to receive the wickets 26. A plurality of protrusions 22 are moulded into the concave elements 21 to fix the handles 211 in position when the case is opened. To the lower case section 1 and upper case section 2, two projections 18 and 28 are formed on the exterior to creat supports for the case to stand upright, as shown in FIG. 3.

While the invention has been explained in relation to its preferred embodiments, it is to be understood that various modifications thereof will become apparent to those skilled in the art upon reading this specification. Therefore, it is to be understood that the invention disclosed herein is intended to cover such modifications as fall within the scope of the appended claims.

I claim:

1. A case for croquet equipment, which is substantially rectangular, comprising a lower case section and an upper case section, on each outer surface of said case sections, a plurality of symmetrical grooves being disposed; said case sections being moulded integrally to form a hinge at one side and a handle arranged on the opposite side of said lower case section; two locks being set at each side of said handle; in said upper case section, a plurality of concave elements, U-shaped recesses and protrusions being moulded; in said lower case section, a plurality of sockets, recesses and semicircular recesses being moulded; two projections being provided on the outer surface of said upper and lower case section.

* * * * *